US011087702B2

(12) United States Patent
Chen

(10) Patent No.: US 11,087,702 B2
(45) Date of Patent: Aug. 10, 2021

(54) METHOD AND DEVICE FOR CONTROLLING BRIGHTNESS OF DISPLAY DEVICE BASED ON AREA DIMMING VALUE AND SATURATION DEGREE, AND LIQUID CRYSTAL DISPLAY

(71) Applicants: HKC CORPORATION LIMITED, Shenzhen (CN); CHONGQING HKC OPTOELECTRONICS TECHNOLOGY CO., LTD., Chongqing (CN)

(72) Inventor: Wei Chen, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/043,189

(22) PCT Filed: Dec. 25, 2018

(86) PCT No.: PCT/CN2018/123450
§ 371 (c)(1),
(2) Date: Sep. 29, 2020

(87) PCT Pub. No.: WO2020/062665
PCT Pub. Date: Apr. 2, 2020

(65) Prior Publication Data

US 2021/0056919 A1 Feb. 25, 2021

(30) Foreign Application Priority Data

Sep. 26, 2018 (CN) ..... 201811129036.4

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 2300/0814* (2013.01); *G09G 2310/06* (2013.01); *G09G 2320/062* (2013.01)

(58) Field of Classification Search
None
See application file for complete search history.

(56) References Cited

U.S. PATENT DOCUMENTS

2013/0215161 A1 8/2013 Cho et al.
2016/0019863 A1 1/2016 Chuang
2017/0256234 A1 9/2017 Nakanishi et al.

FOREIGN PATENT DOCUMENTS

CN 101281733 A 10/2008
CN 101378514 A 3/2009
(Continued)

OTHER PUBLICATIONS

First Office Action in counterpart Chinese Application No. 201811129036.4, dated Jan. 15, 2020.
(Continued)

*Primary Examiner* — Chad M Dicke
(74) *Attorney, Agent, or Firm* — Westbridge IP LLC

(57) ABSTRACT

Disclosed are a method and a device for controlling brightness of a display device, and a liquid crystal display. In the method, a saturation signal and an area dimming signal of each of partitioned screens of the display panel are acquired, and a saturation dimming signal of each of partitioned screens of the display panel is calculated according to the saturation signal, for adjusting the backlight brightness.

15 Claims, 3 Drawing Sheets

(56) References Cited

FOREIGN PATENT DOCUMENTS

| | | | | | |
|---|---|---|---|---|---|
| CN | 101593507 | A | * | 12/2009 | ..... G09G 3/3406 |
| CN | 101645230 | A | | 2/2010 | |
| CN | 101668108 | A | | 3/2010 | |
| CN | 102298906 | A | | 12/2011 | |
| CN | 103996382 | A | | 8/2014 | |
| CN | 105047145 | A | | 11/2015 | |
| CN | 106782368 | A | | 5/2017 | |
| CN | 107610654 | A | | 1/2018 | |
| CN | 107886896 | A | | 4/2018 | |
| CN | 108141576 | A | | 6/2018 | |
| CN | 109036334 | A | | 12/2018 | |

OTHER PUBLICATIONS

International Search Report and Written Opinion in corresponding PCT Application No. PCT/CN2018/123450, dated Jul. 5, 2019.

* cited by examiner

METHOD AND DEVICE FOR CONTROLLING BRIGHTNESS OF DISPLAY DEVICE BASED ON AREA DIMMING VALUE AND SATURATION DEGREE, AND LIQUID CRYSTAL DISPLAY

CROSS-REFERENCE TO RELATED APPLICATIONS

The present disclosure is the National Stage of International Application No. PCT/CN2018/123450, filed on Dec. 25, 2018, which claims the priority of Chinese Patent Application No. 201811129036.4, entitled "METHOD AND DEVICE FOR CONTROLLING BRIGHTNESS OF DISPLAY DEVICE", filed on Sep. 26, 2018, which is hereby incorporated by reference in its entirety.

FIELD

The present disclosure relates to the technical field of display panel, in particular to a method and device for controlling brightness of a display device, and a liquid crystal display.

BACKGROUND

RGBW (Red, Green, Blue, and White) technology is a newly emerging display technology. Compared with RGB (Red, Green, and Blue) technology, RGBW technology has a lower power consumption, and this advantage of RGBW technology is increasingly apparent with gradually increased awareness of energy saving and emission reduction.

RGBW algorithm further has white pixels "W" compared with RGB algorithm. The aperture ratio of RGBW panel is 75% of that of RGB panel, if RGBW panel and RGB panel both display pure color images. In another word, RGBW panel has a lower brightness, resulting a dark displaying effect, when RGBW panel and RGB panel both display pure color images.

The statements herein only provide background information related to the present disclosure and do not necessarily constitute a prior art.

SUMMARY

It is therefore one main objective of the present disclosure to provide a method for controlling brightness of a display device, aiming to enhance the brightness of pure color image displayed by a four-color display panel.

In order to achieve the above objective, the present disclosure provides a method for controlling brightness of a display device, the display device includes a display panel, a controller, a driving circuit, and a backlight unit; the method includes the following operations:

receiving a video signal and acquiring a saturation signal and an area dimming signal of each of partitioned screens of the display panel by the controller;

calculating a saturation dimming signal of each of partitioned screens according to the saturation signal by the controller; and controlling the driving circuit to adjust brightness of the light emitting component in the backlight unit according to the area dimming signal and the saturation dimming signal by the controller, for adjusting backlight brightness of a corresponding area of the display panel.

Optionally, the operation of "calculating a saturation dimming signal of each of partitioned screens according to the saturation signal by the controller" includes:

adopting following formula by the controller to calculate the saturation dimming signal according to the saturation signal:

$$d=1/a+(a-1)*s/a;$$

and d is regarded as the saturation dimming signal, a is regarded as a current gain adjustment parameter, and s is regarded as the saturation signal.

Optionally, the operation of "calculating a saturation dimming signal of each of partitioned screens according to the saturation signal by the controller" includes:

adopting following formula by the controller to calculate the saturation dimming signal according to the saturation signal:

$$d=0.8+0.2s;$$

and d is regarded as the saturation dimming signal and s is regarded as the saturation signal.

Optionally, the operation of "controlling the driving circuit to adjust brightness of the light emitting component in the backlight unit according to the area dimming signal and the saturation dimming signal by the controller, for adjusting backlight brightness of a corresponding area of the display panel" includes:

assigning weighting coefficients to the area dimming signal and the saturation dimming signal respectively; and adjusting a duty ratio of the light emitting component on the corresponding area of the display panel according to a sum of a product of the area dimming signal and its weight coefficient and a product of the saturation dimming signal and its weight coefficient, for adjusting the backlight brightness.

Optionally, a sum of the weight coefficient of the area dimming signal and the weight coefficient of the saturation dimming signal is 1.

The present disclosure also provides a display device, which includes a display panel, a controller, a driving circuit, and a backlight unit, the backlight unit includes a light emitting component.

The controller is configured to receive a video signal and acquire a saturation signal and an area dimming signal of each of partitioned screens of the display panel.

The controller is also configured to calculate a saturation dimming signal of each of partitioned screens according to the saturation signal.

The controller is further configured to adjust a duty ratio of the light emitting component on a corresponding area of the display panel according to the area dimming signal and the saturation dimming signal, for adjusting the backlight brightness.

Optionally, the controller adopts the following formula to calculate the saturation dimming signal:

$$d=1/a+(a-1)*s/a;$$

and d is regarded as the saturation dimming signal, a is regarded as a current gain adjustment parameter, and s is regarded as the saturation signal.

Optionally, the controller adopts the following formula to calculate the saturation dimming signal:

$$d=0.8+0.2s;$$

and d is regarded as the saturation dimming signal and s is regarded as the saturation signal.

Optionally, the backlight adjusting module is configured to assign weighting coefficients to the area dimming signal and the saturation dimming signal respectively, and configured to adjust the duty ratio of the light emitting component on the corresponding area of the display panel according to a sum of a product of the area dimming signal and its weight coefficient and a product of the saturation dimming signal and its weight coefficient, for adjusting the backlight brightness.

Optionally, a sum of the weight coefficient of the area dimming signal and the weight coefficient of the saturation dimming signal is 1.

The present disclosure further provides a liquid crystal display which includes a display panel, a controller, a driving circuit, and a backlight unit, the backlight unit includes a light emitting component.

The controller is configured to receive a video signal and acquire a saturation signal and an area dimming signal of each of partitioned screens of the display panel.

The controller is also configured to calculate a saturation dimming signal of each of partitioned screens according to the saturation signal.

The controller is further configured to conduct a logical add operation to the area dimming signal and the saturation dimming signal, then output the result to the driving circuit, and adjust brightness of the light emitting component through the driving circuit for adjusting backlight brightness of a corresponding area of the display panel.

According to the technical solution of the present disclosure, the saturation signal and the area dimming signal of each of partitioned screens of the display panel are obtained according to the received video signal, and the saturation dimming signal of each of partitioned screens can be calculated according to the saturation signal, so that backlight brightness of the backlight unit of the display panel can be adjusted through the area dimming signal and the saturation signal. Therefore, the brightness of the pure color image can be enhanced by increasing the duty ratio of light emitting component in the backlight unit.

BRIEF DESCRIPTION OF THE DRAWINGS

To clearly illustrate the technical solutions that are reflected in various embodiments according to this disclosure or that are found in the prior art, the accompanying drawings intended for the description of the embodiments herein or for the prior art will now be briefly described, it is evident that the accompanying drawings listed in the following description show merely some embodiments according to this disclosure, and that those having ordinary skill in the art will be able to obtain other drawings based on the arrangements shown in these drawings without making inventive efforts.

Figure 1:
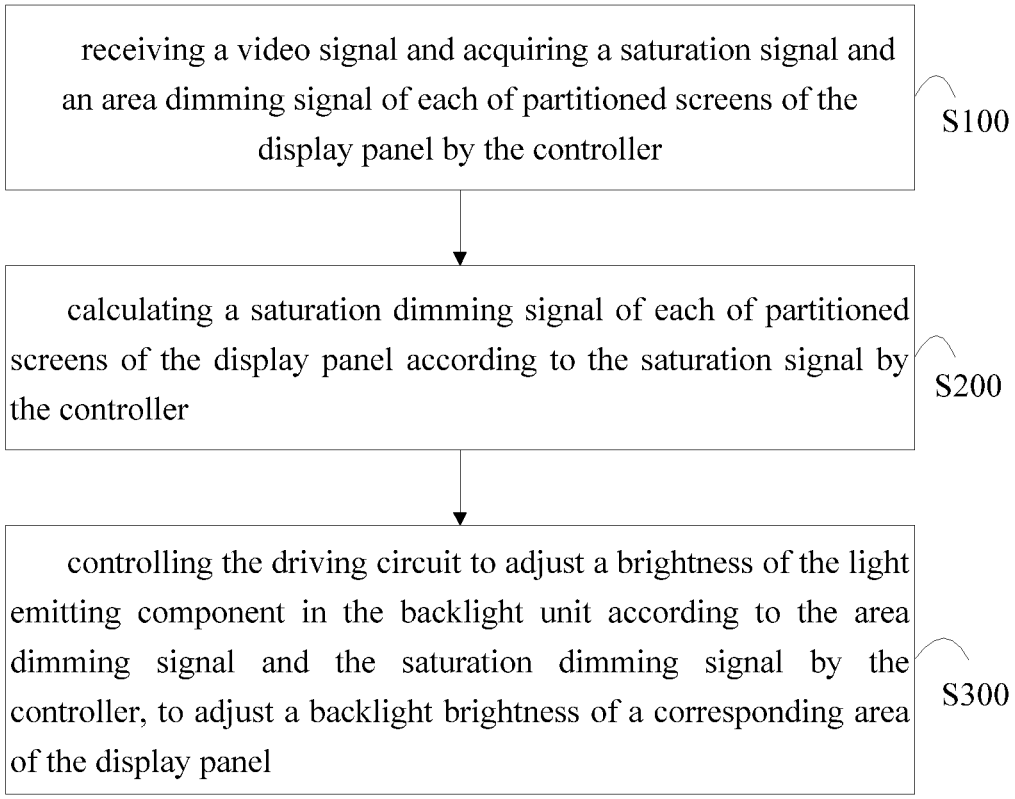
FIG. 1 is a flowchart of a method for controlling brightness of a display device according to an exemplary embodiment of the present disclosure.

The realization of the aim, functional characteristics, advantages of the present disclosure are further described specifically with reference to the accompanying drawings and embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the exemplary embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides a method for controlling brightness of a display device. In the exemplary embodiment, the display device adopts a liquid crystal display panel. In the exemplary embodiment, the display device adopts a RGBW technology. RGBW technology further has white sub-pixels compared with the RGB technology, as such RGBW technology can be regarded as a pixel design having four kinds of colors, which belongs to a sub-pixel rendering technology. In the new pixel arrangement, the color performances are consistent, and the light transmittance of the liquid crystal panel is greatly improved. As such, the display panel using RGBW technology consumes less power than the display panel using RGB technology when the two kinds of display panels display the images with the same brightness. In the case where the two kinds of display panels consume the same power, the brightness of the display panel using the RGBW technology is greater than that of the display panel using the RGB technology. Therefore, in the display panel adopting RGBW technology, the image hierarchy is more distinct and the image is more transparent.

Figure 5:
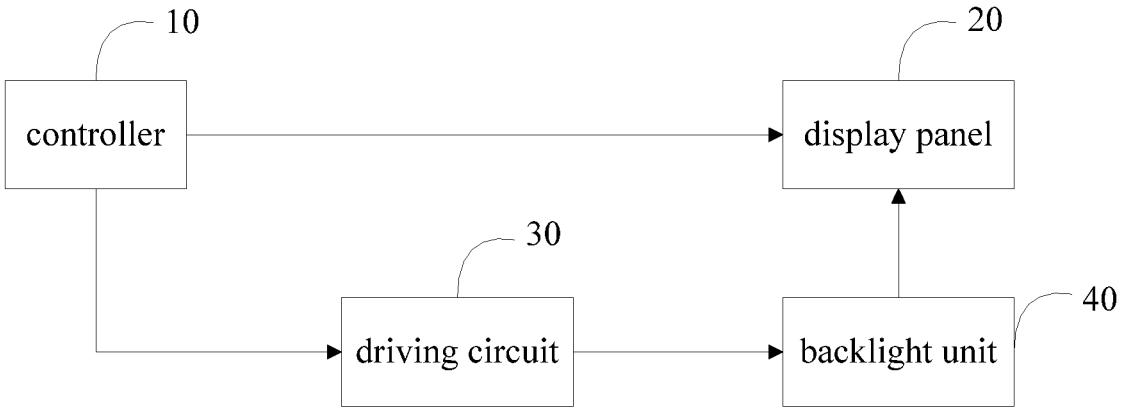
FIG. 5 is a functional block diagram of a display device according to an exemplary embodiment of the present disclosure.

Referring to FIGS. 1 and 5, in the exemplary embodiment of the present disclosure, the display device includes a display panel 20, a controller 10, a driving circuit 30, and a backlight unit 40. The method for controlling brightness of the display device includes the following operations:

S100, receiving a video signal and acquiring a saturation signal and an area dimming signal of each of partitioned screens of the display panel 20 by the controller 10.

It should be noted that the display device has an area dimming function, so the display panel 20 has a plurality of backlight partitions which are corresponding to a plurality of partitioned screens. The controller 10 analyzes the saturation signal and the area dimming signal of each of the partitioned screens according to the received video signal.

S200, calculating a saturation dimming signal of each of partitioned screens according to the saturation signal by the controller 10. The controller 10 calculates the saturation dimming signal through bringing the saturation signal into a preset formula;

S300, adjusting brightness of the backlight unit through the driving circuit 30 according to the area dimming signal and the saturation dimming signal by the controller 10, for adjusting backlight brightness of a corresponding area of the display panel 20. It is easy to understand that the backlight unit includes a light emitting component which can be a light emitting diode (LED) lamp. The brightness of the backlight unit can be adjusted by controlling the duty ratio of the LED lamp.

Duty ratio refers to a percentage of a time that a circuit is turned on in the working cycle of the total circuit. For example, if one circuit is turned on half the working cycle of the total circuit, its duty ratio is 50%, and the average value or effective value of the actual operating voltage is 2.5V when the signal voltage applied to the working component is 5V. It is assumed that the working component is an electronic valve, the valve is widely open when the circuit is turned on at all times; the valve is half open when the duty ratio is 50%. Similarly, when the duty ratio is set to be 20%, the opening degree of the valve should be 20% obviously. In this way, the opening degree of the valve can be arbitrarily adjusted from 0% (closed) to 100% (fully open). In the exemplary embodiment, the controller 10 outputs a PWM control signal to the driving circuit, and adjusts the effective value of the actual operating voltage of the backlight component through controlling the duty ratio of the PWM control signal, thereby adjusting the brightness of the backlight unit.

It should be noted that the RGB signal is usually acquired after receiving the video signal, then the RGB signal can be subjected to an image quality enhancement processing, and the area dimming is performed according to the RGB signal. Optionally, the RGB signal can be converted into RGBW signal, that is, W (white light) signal is added to the RGB signal, then the RGBW signal which is overdrive processed is inputted to the display panel 20.

The area dimming signal and the saturation dimming signal are combined to control the duty ratio of the light emitting component of the display panel 20. Furthermore, in the exemplary embodiment of the present disclosure, the logic add operation is performed on the area dimming signal and the saturation dimming signal, and the obtained result is outputted to the driving board of the light emitting component of the display panel 20.

According to the technical solution of the present disclosure, the saturation signal and the area dimming signal of each of partitioned screens of the display panel 20 are obtained according to the received video signal, and the saturation dimming signal of each of partitioned screens can be calculated according to the saturation signal, so that brightness and the duty ratio of the light emitting component of the display panel 20 can be adjusted and determined by the area dimming signal and the saturation signal, and therefore the brightness of the pure color image can be enhanced by increasing the duty ratio of light emitting component.

In detail the operation of "calculating a saturation dimming signal of each of partitioned screens according to the saturation signal by the controller 10" includes:

adopting the following formula to calculate the saturation dimming signal:

$$d=1/a+(a-1)*s/a;$$

d is regarded as the saturation dimming signal, a is regarded as a current gain adjustment parameter, and s is regarded as the saturation signal. It is easy to understand that the current gain adjustment parameter can be flexibly set according to the effect of the actual adjustment.

In the exemplary embodiment, the operation of "calculating a saturation dimming signal of each of partitioned screens according to the saturation signal by the controller 10" includes:

adopting the following formula to calculate the saturation dimming signal:

$$d=0.8+0.2s;$$

d is regarded as the saturation dimming signal and s is regarded as the saturation signal. In the exemplary embodiment, the preset formula is d=1/a+(a−1)*s/a. When a is defined as 1.25, the specific formula can be d=0.8+0.2s.

Figure 2:
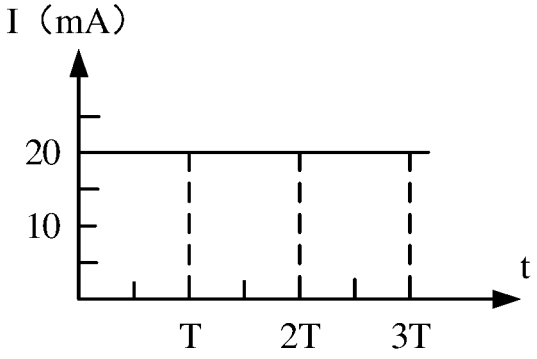
FIG. 2 is a schematic diagram of a relationship between operating current and operating period of a light emitting component of display panel in an existing technology.

Referring to FIG. 2, it should be noted that the constant current of the light emitting component of the display panel 20 is 20 mA (milliampere) when the brightness of the backlight unit is adjusted without the saturation dimming signal, and if the duty ratio of the lighting component is 100% when displaying the white image, in this case the average current of the light emitting component is 20 mA.

Figure 3:
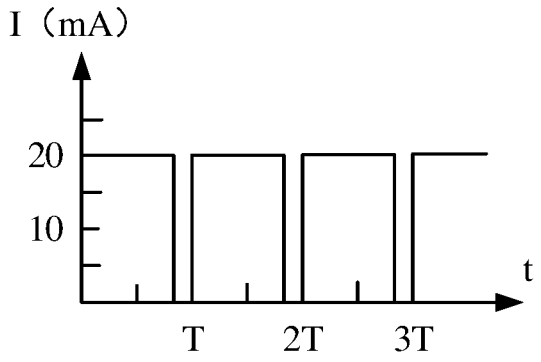
FIG. 3 is a schematic diagram of a relationship between operating current and operating period of a light emitting component of the method for controlling brightness of display device of the present disclosure.
Figure 4:
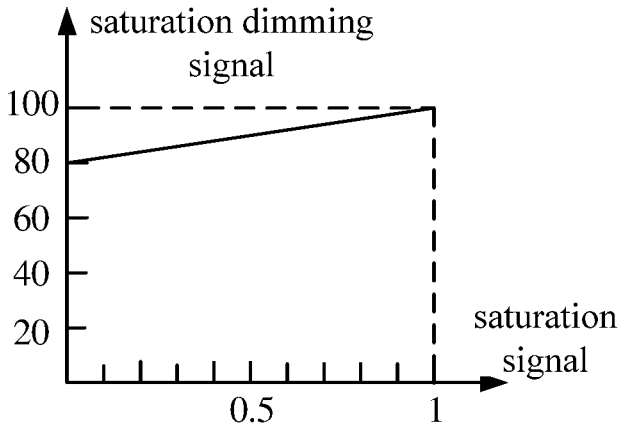
FIG. 4 is a schematic diagram of a relationship between saturation dimming signal and saturation of the method for controlling brightness of the display device according to an exemplary embodiment of the present disclosure.

Referring to FIGS. 3 and 4, in the exemplary embodiment, the current of the light emitting component is increased to 25 mA first, and the duty ratio of the light emitting component is adjusted to 80% when displaying the white image, at this time the average current is also 20 mA. On the basis that the current of the light emitting component is 25 mA and the duty ratio is 80%, if the duty ratio of the light emitting component can be further adjusted by the saturation dimming signal, the functional relationship between the saturation dimming signal and the saturation is as follows:

$$d=0.8+0.2s.$$

In this way, when the saturation is 0 (i.e. white image), the overall brightness is unchanged; when the saturation is 1 (i.e. pure color image), the overall brightness can be increased by 25%.

According to the statistics, the duty ratio of the light emitting component of each of partitions of the display panel 20 can be further adjusted by the saturation dimming processing, which can completely solve the problem of insufficient brightness when the display panel adopting the RGBW technology displays the pure color image.

In the exemplary embodiment, the operation of "adjusting brightness of the light emitting component through the driving circuit 30 according to the area dimming signal and the saturation dimming signal by the controller 10, for adjusting backlight brightness of a corresponding area of the display panel 20" includes:

assigning weighting coefficients to the area dimming signal and the saturation dimming signal respectively; and adjusting a duty ratio of the light emitting component on the corresponding area of the display panel 20 according to a sum of a product of the area dimming signal and its weight coefficient and a product of the saturation dimming signal and its weight coefficient, for adjusting the backlight brightness.

Optionally, a sum of the weight coefficient of the area dimming signal and the weight coefficient of the saturation dimming signal is 1.

It should be noted that the weight coefficients of the area dimming signal and the saturation dimming signal may be appropriately adjusted according to actual needs. The weight coefficients of the regional dimming signal and the saturation dimming signal respectively represent their respective proportions when configured for adjusting the duty ratio of the light emitting component of the display panel 20.

Referring to FIG. 5, the present disclosure further provides a display device based on the above mentioned method for controlling the brightness of display device. The display device includes: a display panel 20, a controller 10, a driving circuit 30, and a backlight unit 40, and the backlight unit 40 includes a light emitting component. It should be noted that the driving circuit 30 is connected to the controller 10, and the backlight unit 40 is connected to the driving circuit 30.

The controller 10 is configured to receive a video signal and acquire a saturation signal and an area dimming signal of each of partitioned screens of the display panel 20.

The controller 10 is also configured to calculate a saturation dimming signal of each of partitioned screens according to the saturation signal.

The controller 10 is further configured to adjust brightness of the light emitting component through the driving circuit 30 according to the area dimming signal and the saturation dimming signal, for adjusting backlight brightness of a corresponding area of the display panel 20.

In the exemplary embodiment, the display device has an area dimming function, so the display panel 20 has a plurality of backlight partitions which are corresponding to a plurality of partitioned screens. The controller 10 analyzes the saturation signal and the area dimming signal of each of the partitioned screens according to the received video signal.

Optionally, the controller 10 adopts the following formula to calculate the saturation dimming signal:

$$d=1/a+(a-1)*s/a;$$

d is regarded as the saturation dimming signal, a is regarded as a current gain adjustment parameter, and s is regarded as the saturation signal.

In the exemplary embodiment, when a is defined as 1.25, the controller 10 adopts the following formula to calculate the saturation dimming signal:

$$d=0.8+0.2s;$$

d is regarded as the saturation dimming signal and s is regarded as the saturation signal. When a is defined as 1.25, the calculating formula can be d=0.8+0.2s, the saturation dimming signal can be calculated according to the above formula to achieve an ideal dimming effect.

Optionally, the controller 10 is configured to assign weighting coefficients to the area dimming signal and the saturation dimming signal respectively, and configured to adjust a duty ratio of the light emitting component on the corresponding area of the display panel 20 according to a sum of a product of the area dimming signal and its weight coefficient and a product of the saturation dimming signal and its weight coefficient, for adjusting the backlight brightness.

It should be noted that, a sum of the weight coefficient of the area dimming signal and the weight coefficient of the saturation dimming signal is 1.

The technical solution of the present disclosure adopts the RGBW technology, as such when the saturation is 0 (i.e. white image), the overall brightness is unchanged; when the saturation is 1 (i.e. pure color image), the overall brightness can be increased by 25%. Therefore, the power consumption of the display is reduced, meanwhile the brightness of the pure color image is improved, further improving the display effect.

The present disclosure further provides a liquid crystal display which includes a display panel, a controller, a driving circuit, and a backlight unit, the backlight unit includes a light emitting component.

The controller is configured to receive a video signal and acquire a saturation signal and an area dimming signal of each of partitioned screens of the display panel. The controller is also configured to calculate a saturation dimming signal of each of partitioned screens according to the saturation signal. The controller is further configured to conduct a logical add operation to the area dimming signal and the saturation dimming signal, then output the result to the driving circuit, and adjust brightness of the light emitting component through the driving circuit for adjusting backlight brightness of a corresponding area of the display panel.

The foregoing description merely portrays some illustrative embodiments according to the disclosure and therefore is not intended to limit the patentable scope of the disclosure. Any equivalent structural or flow transformations that are made taking advantage of the specification and accompanying drawings of the disclosure and any direct or indirect present disclosures thereof in other related technical fields shall all fall in the scope of protection of the disclosure. Therefore, the scope of protection of this disclosure shall be subject to the claims.

What is claimed is:

1. A method for controlling brightness of a display device, wherein the display device comprises a display panel, a controller, a driving circuit, and a backlight unit having a light emitting component;

the method comprises the following operations:

receiving a video signal and analyzing a saturation degree and an area dimming value of each of partitioned screens of the display panel from the video signal by the controller;

calculating a saturation dimming signal of each of partitioned screens of the display panel according to the saturation degree by the controller; and controlling the driving circuit to adjust brightness of the light emitting component in the backlight unit according to the area dimming value and the saturation dimming signal by the controller, for adjusting backlight brightness of a corresponding area of the display panel;

wherein the operation of "calculating a saturation dimming signal of each of partitioned screens according to the saturation degree by the controller" comprises:

adopting the following formula by the controller to calculate the saturation dimming signal according to the saturation degree:

$$d=1/a+(a-1)*s/a;$$

where d is regarded as the saturation dimming signal, a is regarded as a current gain adjustment parameter, and s is regarded as the saturation degree.

2. The method according to claim 1, wherein a in the formula is equal to 1.25.

3. The method according to claim 1, wherein the operation of "controlling the driving circuit to adjust brightness of the light emitting component in the backlight unit according to the area dimming value and the saturation dimming signal by the controller, for adjusting backlight brightness of a corresponding area of the display panel" comprises:

assigning weighting coefficients to the area dimming value and the saturation dimming signal respectively; and adjusting a duty ratio of the light emitting component on the corresponding area of the display panel according to a sum of a product of the area dimming value and its weight coefficient and a product of the saturation dimming signal and its weight coefficient, for adjusting the backlight brightness.

4. The method according to claim 3, wherein, a sum of the weight coefficient of the area dimming value and the weight coefficient of the saturation dimming signal is 1.

5. The method according to claim 1, wherein the display panel comprises white sub-pixels, red sub-pixels, green sub-pixels, and blue sub-pixels.

6. A display device, comprising:

a display panel, a controller, a driving circuit, and a backlight unit, wherein the backlight unit comprises a light emitting component, wherein:

the controller is configured to receive a video signal and analyze a saturation degree and an area dimming value of each of partitioned screens of the display panel from the video signal;

the controller is also configured to calculate a saturation dimming signal of each of partitioned screens according to the saturation degree; and the controller is further configured to adjust brightness of the light emitting component through the driving circuit according to the area dimming value and the saturation dimming signal, for adjusting backlight brightness of a corresponding area of the display panel;

wherein the controller adopts the following formula to calculate the saturation dimming signal:

$$d=1/a+(a-1)*s/a;$$

where d is regarded as the saturation dimming signal, a is regarded as a current gain adjustment parameter, and s is regarded as the saturation degree.

7. The display device according to claim 6, wherein a in the formula is equal to 1.25.

8. The display device according to claim 6, wherein the controller is configured to assign weighting coefficients to the area dimming value and the saturation dimming signal respectively, and configured to adjust a duty ratio of the light emitting component on the corresponding area of the display panel according to a sum of a product of the area dimming value and its weight coefficient and a product of the saturation dimming signal and its weight coefficient, for adjusting the backlight brightness.

9. The display device according to claim 8, wherein a sum of the weight coefficient of the area dimming value and the weight coefficient of the saturation dimming signal is 1.

10. The display device according to claim 8, wherein the display panel comprises white sub-pixels, red sub-pixels, green sub-pixels, and blue sub-pixels.

11. A liquid crystal display, wherein the liquid crystal display comprises a display panel, a controller, a driving circuit, and a backlight unit, the backlight unit comprises a light emitting component, the controller is configured to receive a video signal and analyze a saturation degree and an area dimming value of each of partitioned screens of the display panel;

the controller is also configured to calculate a saturation dimming signal of each of partitioned screens according to the saturation degree; and the controller is further configured to conduct a logical add operation to the area dimming value and the saturation dimming signal, then output the result to the driving circuit, and adjust brightness of the light emitting component through the driving circuit for adjusting backlight brightness of a corresponding area of the display panel;

wherein the controller adopts the following formula to calculate the saturation dimming signal:

$$d=1/a+(a-1)*s/a;$$

where d is regarded as the saturation dimming signal, a is regarded as a current gain adjustment parameter, and s is regarded as the saturation degree.

12. The liquid crystal display according to claim 11, wherein a in the formula is equal to 1.25.

13. The liquid crystal display according to claim 11, wherein the controller is configured to assign weighting coefficients to the area dimming value and the saturation dimming signal respectively, and configured to adjust a duty ratio of the light emitting component on the corresponding area of the display panel according to a sum of a product of the area dimming value and its weight coefficient and a product of the saturation dimming signal and its weight coefficient, for adjusting the backlight brightness.

14. The liquid crystal display according to claim 13, wherein a sum of the weight coefficient of the area dimming value and the weight coefficient of the saturation dimming signal is 1.

15. The liquid crystal display according to claim 11, wherein the display panel comprises white sub-pixels, red sub-pixels, green sub-pixels, and blue sub-pixels.

* * * * *